US005730422A

United States Patent [19]

Chi et al.

[11] Patent Number: 5,730,422

[45] Date of Patent: Mar. 24, 1998

[54] PRESSURE CONTROLLED VALVE

[75] Inventors: Wen-Yu Chi, Taoyuan; Chen-Ko Chuang, Tainan County; Wen-Han Huang; Hsiang-Yu Huang, both of Tainan, all of Taiwan

[73] Assignee: Industrial Technology Research Institute, Hsinchu, Taiwan

[21] Appl. No.: 667,906

[22] Filed: Jun. 20, 1996

[51] Int. Cl.[6] ..... F16K 3/24

[52] U.S. Cl. ..... 251/324; 134/454.2

[58] Field of Search ..... 137/625.69, 454.2; 251/325, 324

[56] References Cited

U.S. PATENT DOCUMENTS 2,910,081 10/1959 Karbowniczeh ..... 251/324 X 3,700,007 10/1972 Sparling et al. ..... 251/324 X 4,491,155 1/1985 Meyer et al. ..... 251/324 X

*Primary Examiner*—John Fox

*Attorney, Agent, or Firm*—W. Wayne Liauh

[57] ABSTRACT

A pressure controlled valve for controlling the actions of a piston within a cylinder including a base, the ends thereof having their outer edges protruding outwardly to form respective seal portions which press tightly against the inner walls of an housing of the cylinder and an open end of the cylinder respectively, a T-shaped shaft with a waist portion capable of displacing axially within the base, the ends of the base further having their inner edges extending inwardly to form respective annular seal portions for pressing tightly against the shaft. The base may consist of a base body and a sleeve accommodated within the base, both of which may have their respective ends extending outwardly or inwardly to form seal portions. The waist portion of the shaft always aligns with a radial hole of the base.

2 Claims, 11 Drawing Sheets

PRESSURE CONTROLLED VALVE

BACKGROUND OF THE INVENTION (a) Field of the Invention

The present invention relates generally to a pressure controlled valve, and more particularly to a pressure controlled valve for controlling cylinders generally used for controlling the lifting mechanism of office chairs.

(b) Description of the Prior Art

As pressure control valves have wide applications, they are often used in controlling gaseous and liquid fluids to channel or control the flow of gas or liquid in a specific apparatus to achieve a specific function, e.g., controlling the actions of pneumatic brakes and the lifting mechanism of office chairs.

Take pneumatic cylinders as an example. Pressure controlled valves in pneumatic cylinders are generally used to control the pressure changes within the pneumatic cylinders so as to achieve positioning and stroke control. The principle of control employed is to utilize the changes in pressure differences between two separate air chambers divided by the piston within the cylinder to push the piston (to be described hereinafter). Hence, it is of extreme importance that the air chambers within the valve are perfectly air-tight. If the air chambers are not properly air-tight, then, either the valve cannot achieve its object of controlling the cylinder or there is a danger that the valve may get out of control. Therefore, conventional pressure controlled valves are generally provided with a plurality of packings to prevent leakage of gas from the enclosed chambers in pneumatic cylinders.

With reference to FIGS. 1–4, a conventional pressure controlled valve essentially comprises a base 1, a first O-ring 2, a sleeve 3, a second O-ring 4, a packing 5, a retainer 6, a shaft 7, a fourth O-ring 8 and a fifth O-ring 8*a* fitted in a cylinder 12 and a housing 13. The cylinder 12 accommodates therein a spring 9, a bushing 10 and a piston 14. At a left side of the cylinder 12, a cover plate 16 is provided, and an oil seal 15 is disposed for preventing air chambers within the housing 13 from communicating with the outside.

Referring to FIG. 2, two separate, enclosed air chambers S1 and S2 are shown in dotted lines. The air chambers S1 and S2 are partitioned by a head portion of the piston 14, in which the air chamber S1 includes the space from intermediate the cylinder 12 and the housing 13 to a right side of the cylinder 12 and through a hole la of the base 1 and a hole 3a of the sleeve 3 to a waist portion 7*a* of the shaft 7.

With reference to FIG. 3, when the shaft 7 is forced to displace to the left, its waist portion 7*a* will protrude from an end portion on the left side of the base 1 and the packing 5 such that the space of the waist 7*a* communicates with the chamber S2. In other words, the air chamber S1 is temporarily associated with the air chamber S2 via the waist portion 7*a* of the shaft 7. As a result of the effect of a change in pressure difference, the piston 14 will displace to the left. When it is released, the shaft 7 will automatically return to the right side, as shown in FIG. 4, so that its waist portion 7*a* only communicates with the air chamber S1. At this point, although the space originally occupied by the air chamber S1 has diminished, the space of the air chamber S2 relatively increases. Nevertheless, a balance of pressure difference between the air chambers is temporarily maintained.

From the foregoing, it can be seen that, the conventional pressure controlled valve uses a large number of sealing elements such as O-rings 2, 4, 8 and 8*a* to ensure the air-tightness and independence of the two air chambers S1 and S2. It can therefore be seen from the above that the performance and life of pressure controlled valves are closely related to the durability and sealing effects of the O-rings. At present, O-rings are generally made of rubber material and may easily wear, undermining their sealing effects. Besides, rubber may easily become hardened in high-temperature environments as a result of change of temperature and the O-rings may no longer be usable.

SUMMARY OF THE INVENTION

Accordingly, a primary object of the present invention is to provide a pressure controlled valve which does not require any O-rings to achieve excellent air-tightness.

Another object of the present invention is to provide a pressure controlled valve of few parts, reducing the material and assembly costs.

A further object of the present invention is to provide a pressure controlled valve which may be mass produced and have stable quality.

Still another object of the present invention is to provide a cylinder, particularly a pneumatic cylinder, controllable by a pressure controlled valve, the cylinder having the advantages of simple construction and easy assembly.

In order to achieve the aforementioned objects, the pressure controlled valve according to the present invention essentially comprises two annular seal portions protruding from the respective outer edges of the ends of a base for urging against a housing of a cylinder and an inner wall of an open end of the cylinder, the base having a T-shaped shaft having a waist portion and being capable of axial displacement therein, the ends of the base having inner edges respectively provided with an inwardly bulging annular seal portion for fitting tightly with the shaft. The base may consist of a base body and a sleeve contained within the base body, both of which have their ends projecting inwardly and outwardly to form annular seal portions to achieve tight connection. The waist portion of the shaft always aligns with a radial hole of the base.

The base may be a single unit, enclosing the housing and the cylinder. If the base is configured to consist of a base body and a sleeve and the sleeve is accommodated within the base body, the manufacturing process may be simplified. In addition, the sleeve may consist of two symmetrical sleeve units assembled together and disposed within the base body. Nonetheless, no matter which option is adopted, the manufacturing process may be simplified, and the base, as well as the sleeve, may be mass produced by injection molding. The annular seal portions of the base may be formed by a plurality of contiguous, concentric rings to enhance air tightness and durability.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
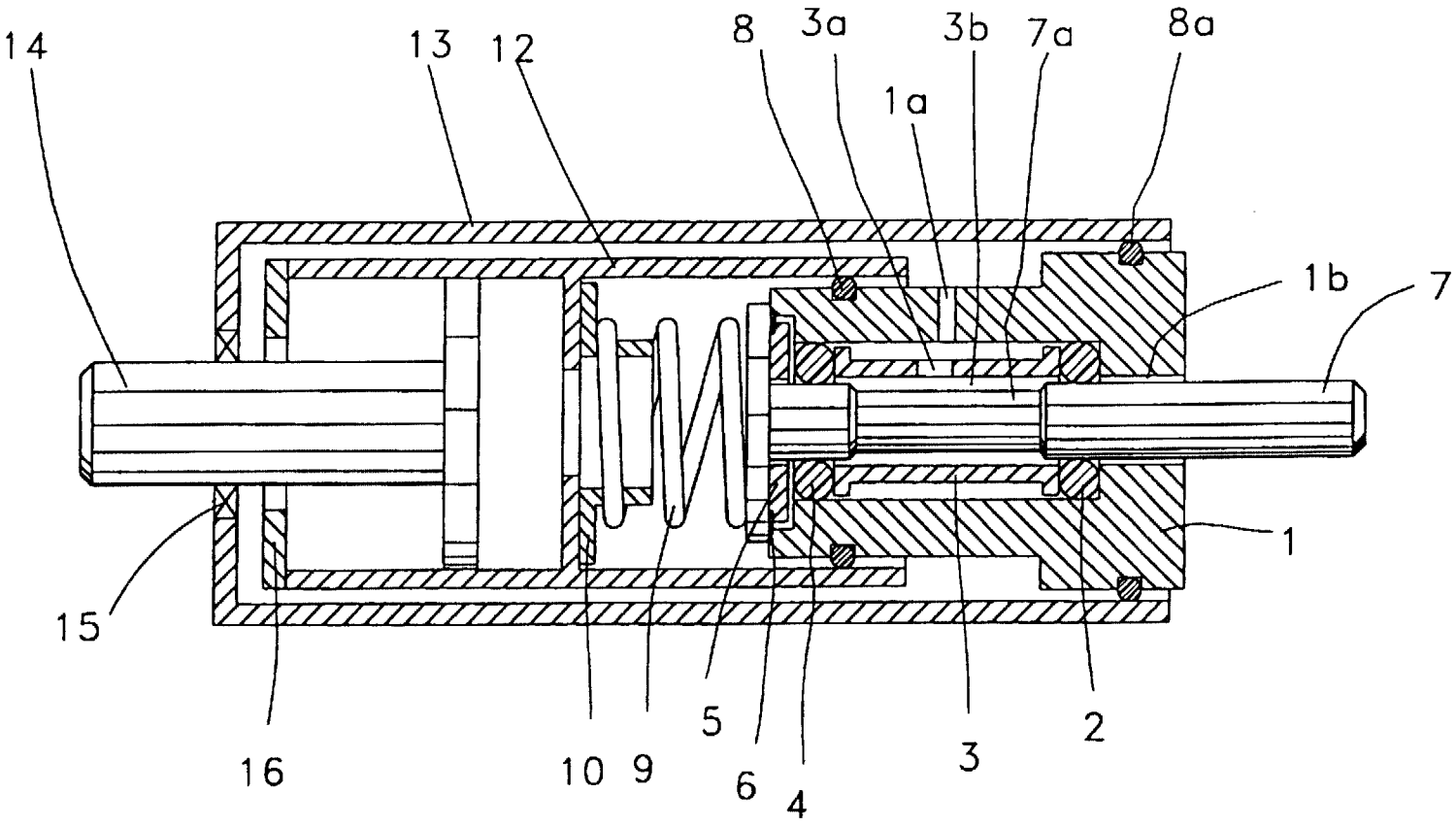
Fig. 1 PRIOR ART
FIGS. 1–4 are respective sectional views of a pneumatic cylinder employing a conventional pressure controlled valve, each illustrating actions of the valve at different stages.
Figure 2:
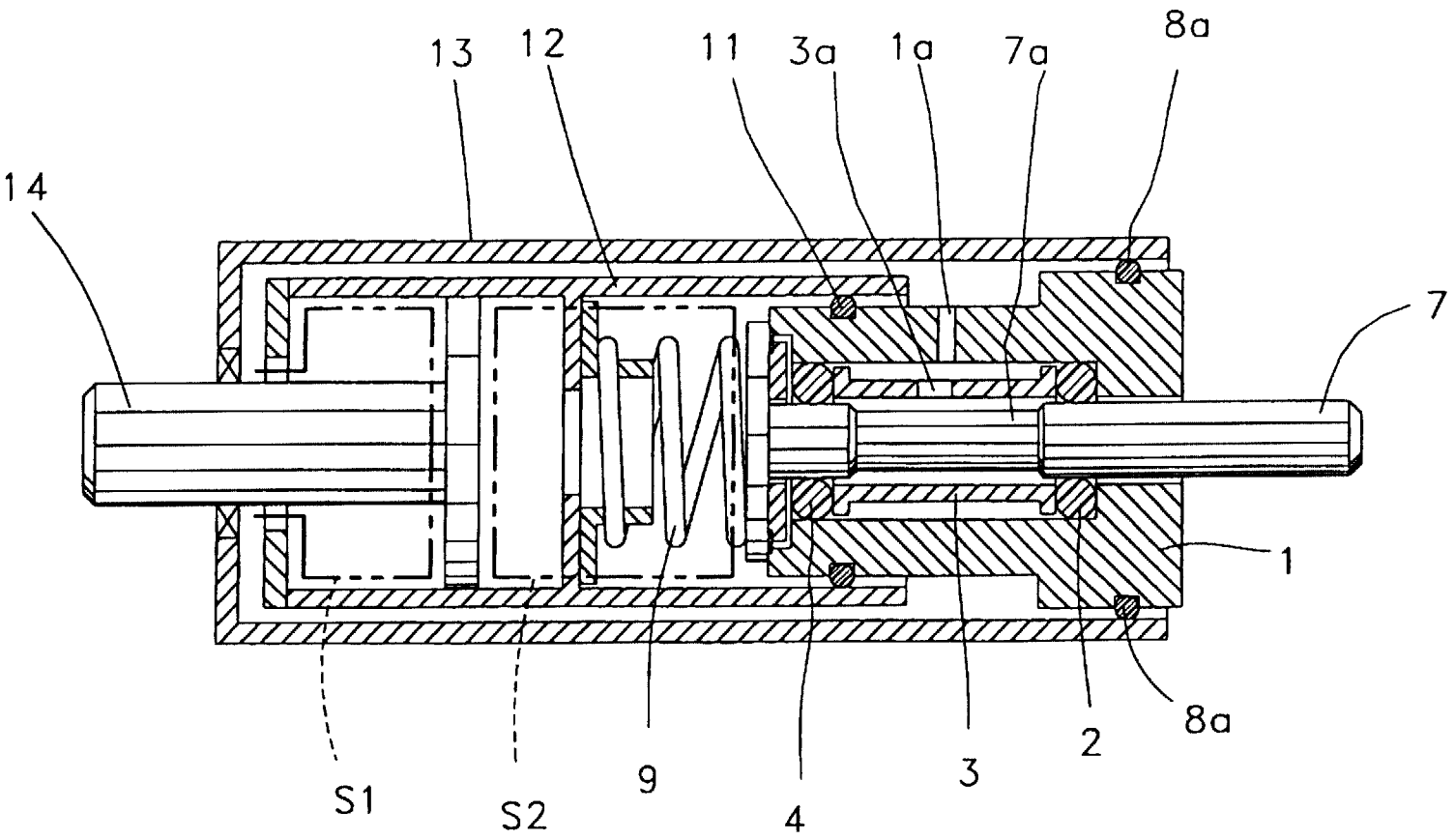
Fig. 2 PRIOR ART
Figure 3:
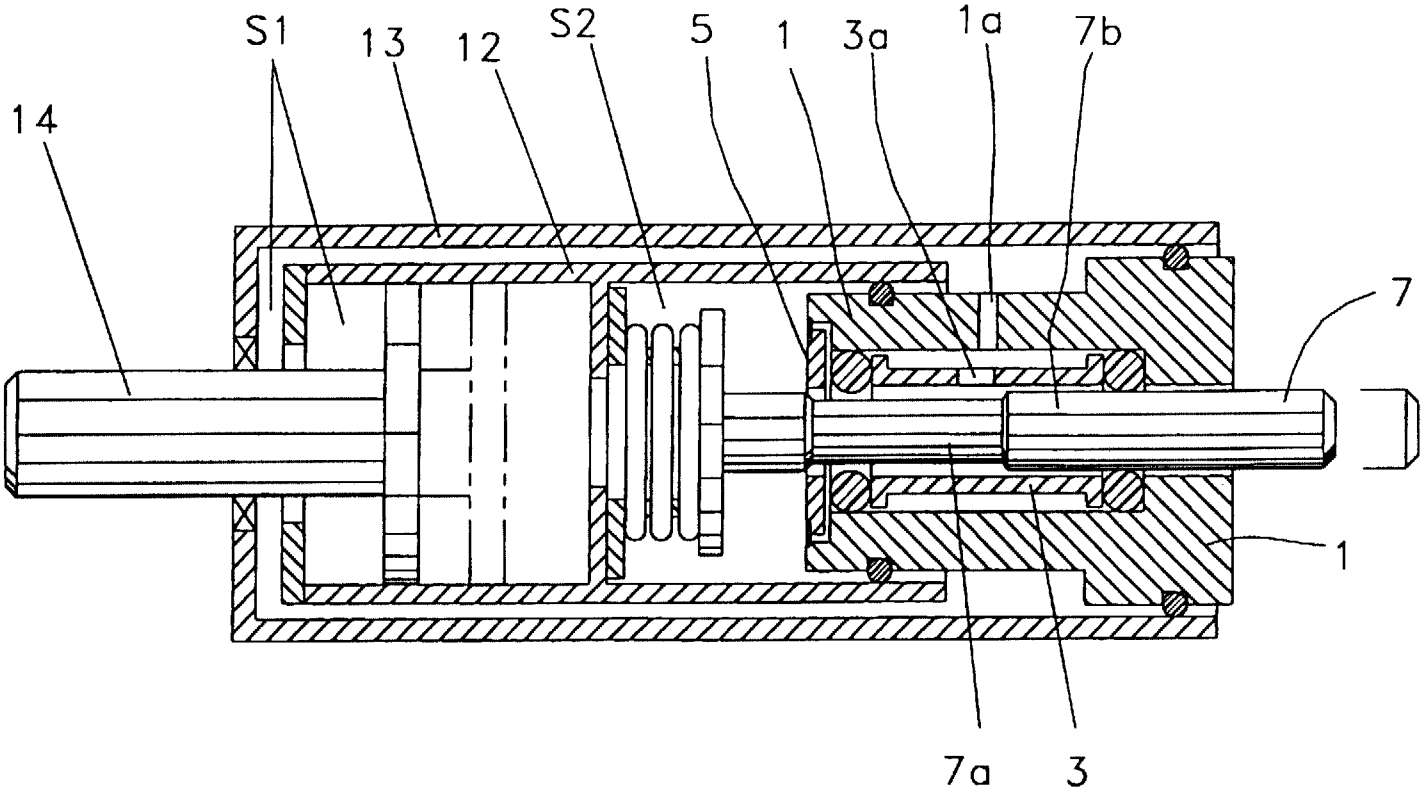
Fig. 3 PRIOR ART
Figure 4:
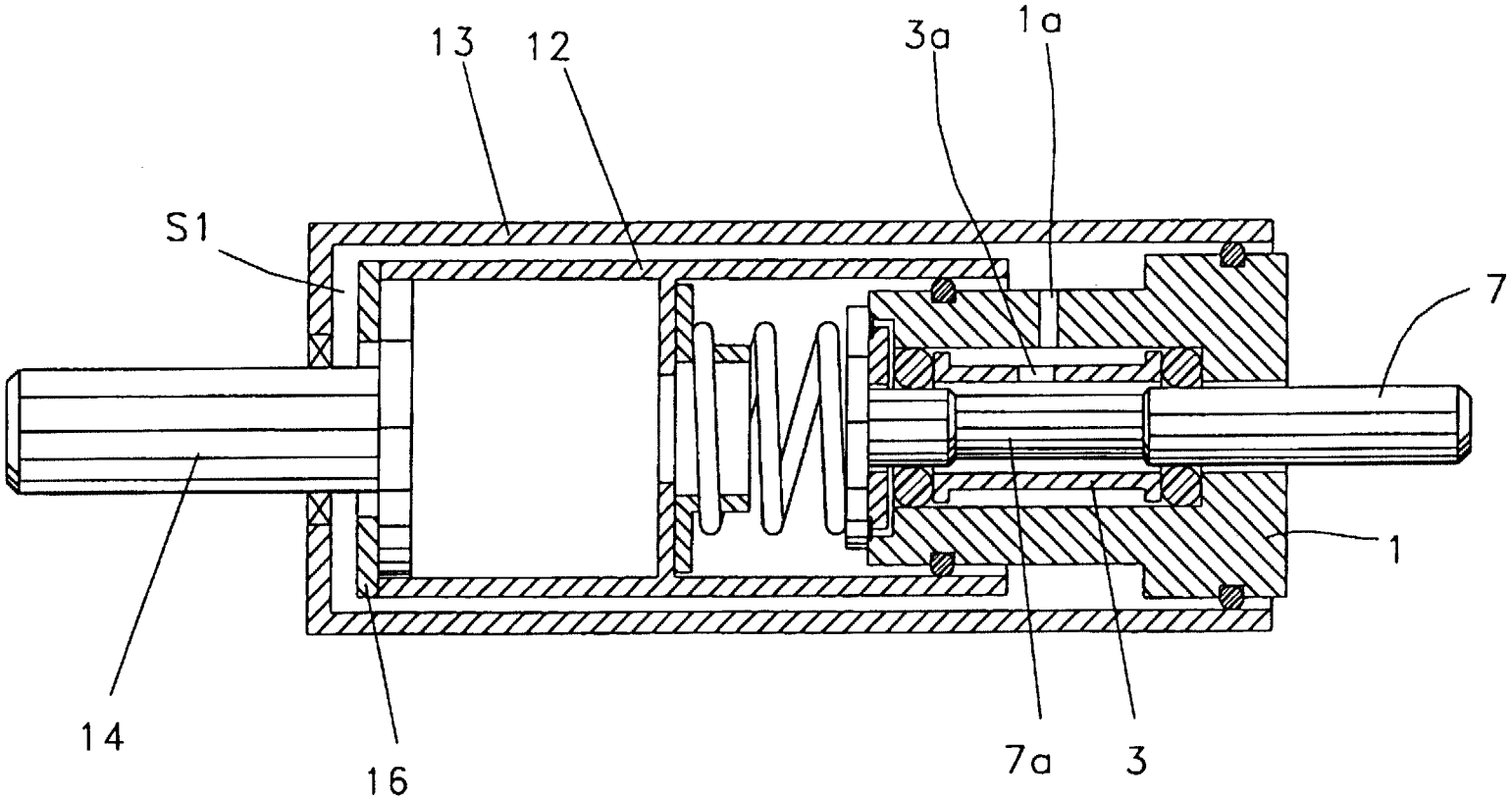
Fig. 4 PRIOR ART
Figure 5:
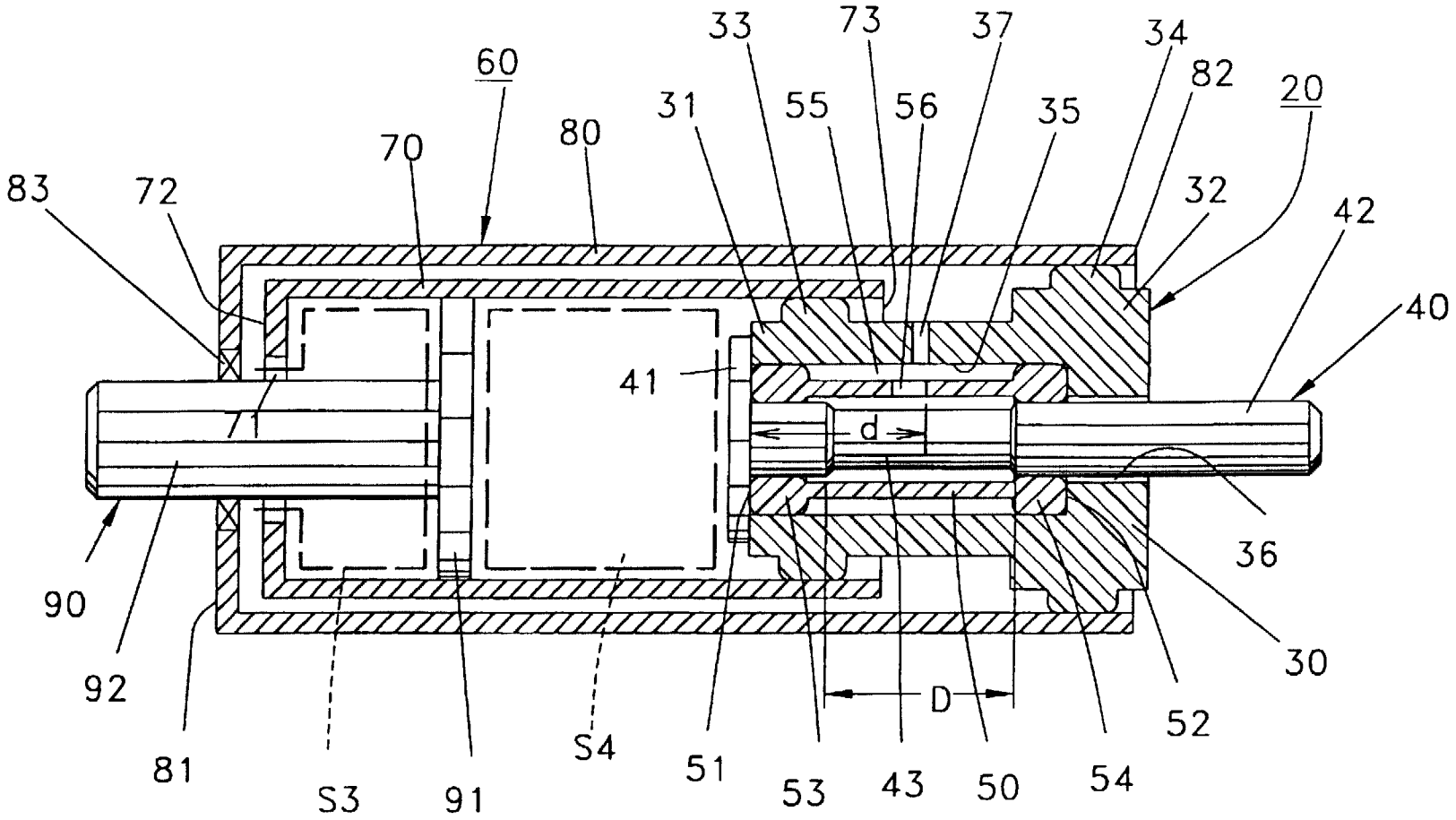
FIGS. 5–7 are respective sectional views of a pneumatic cylinder employing a preferred embodiment of the pressure controlled valve of the present invention, each showing actions of the valve at different stages.
Figure 6:
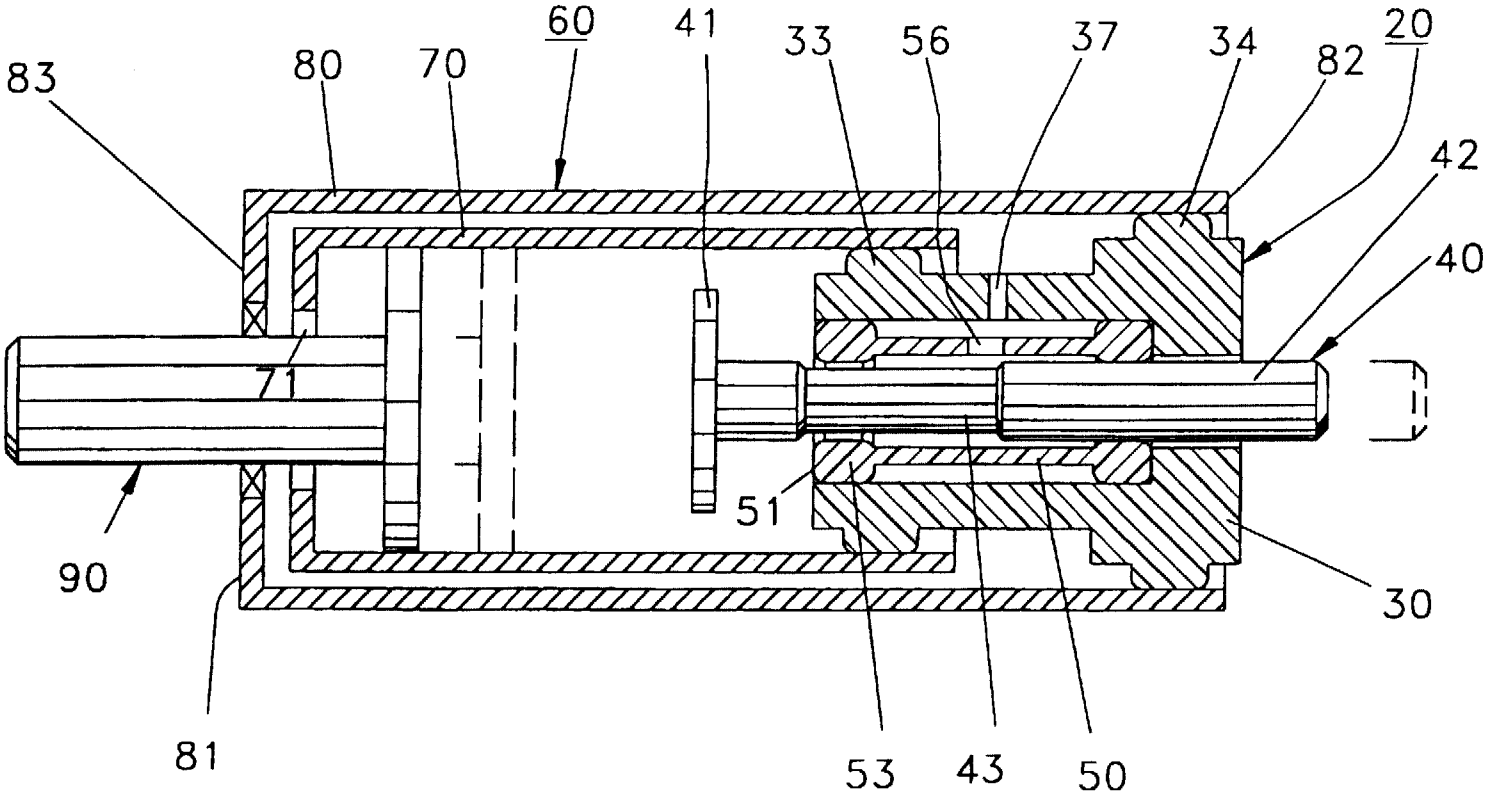
Figure 7:
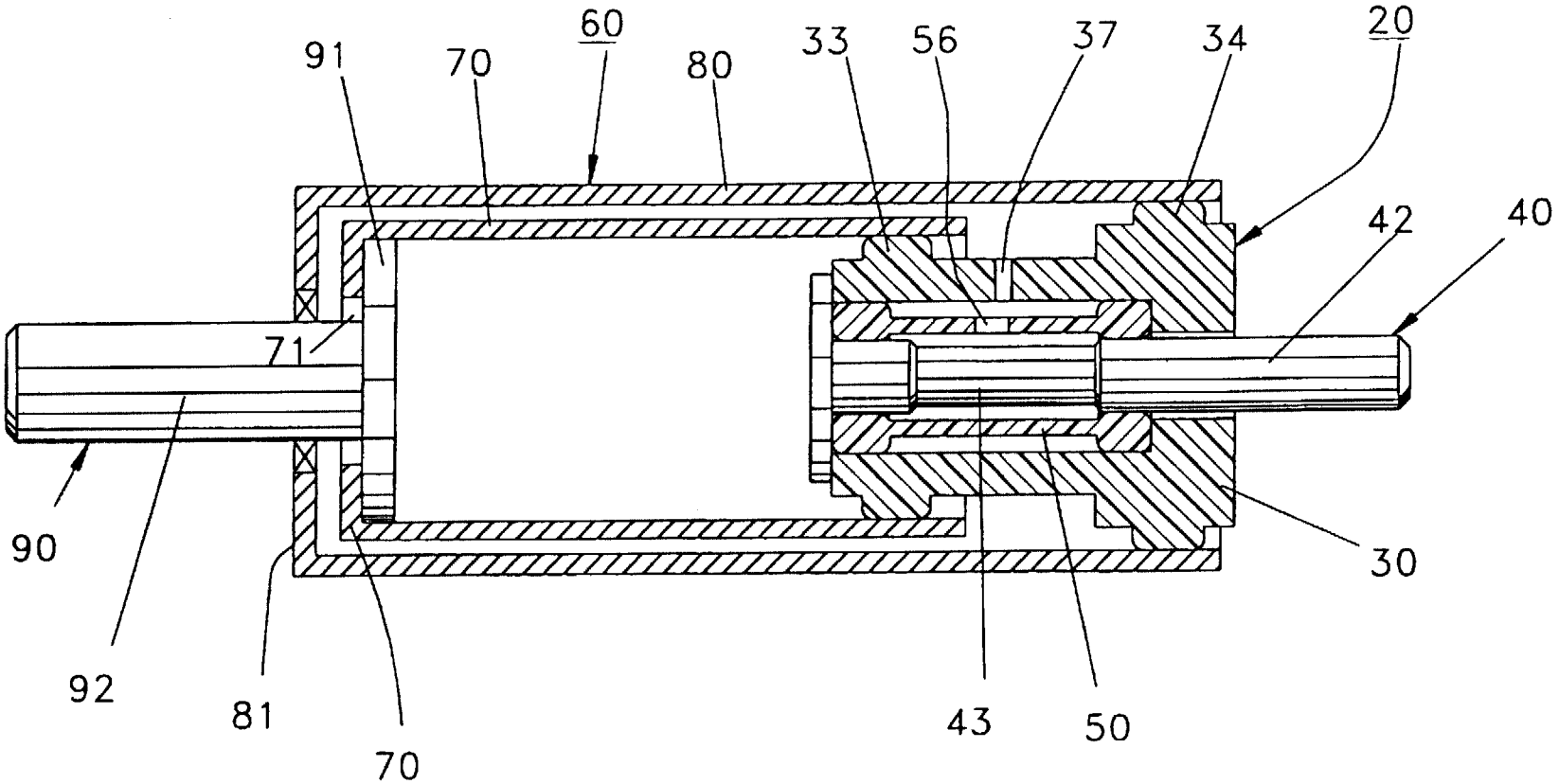
Figure 8:
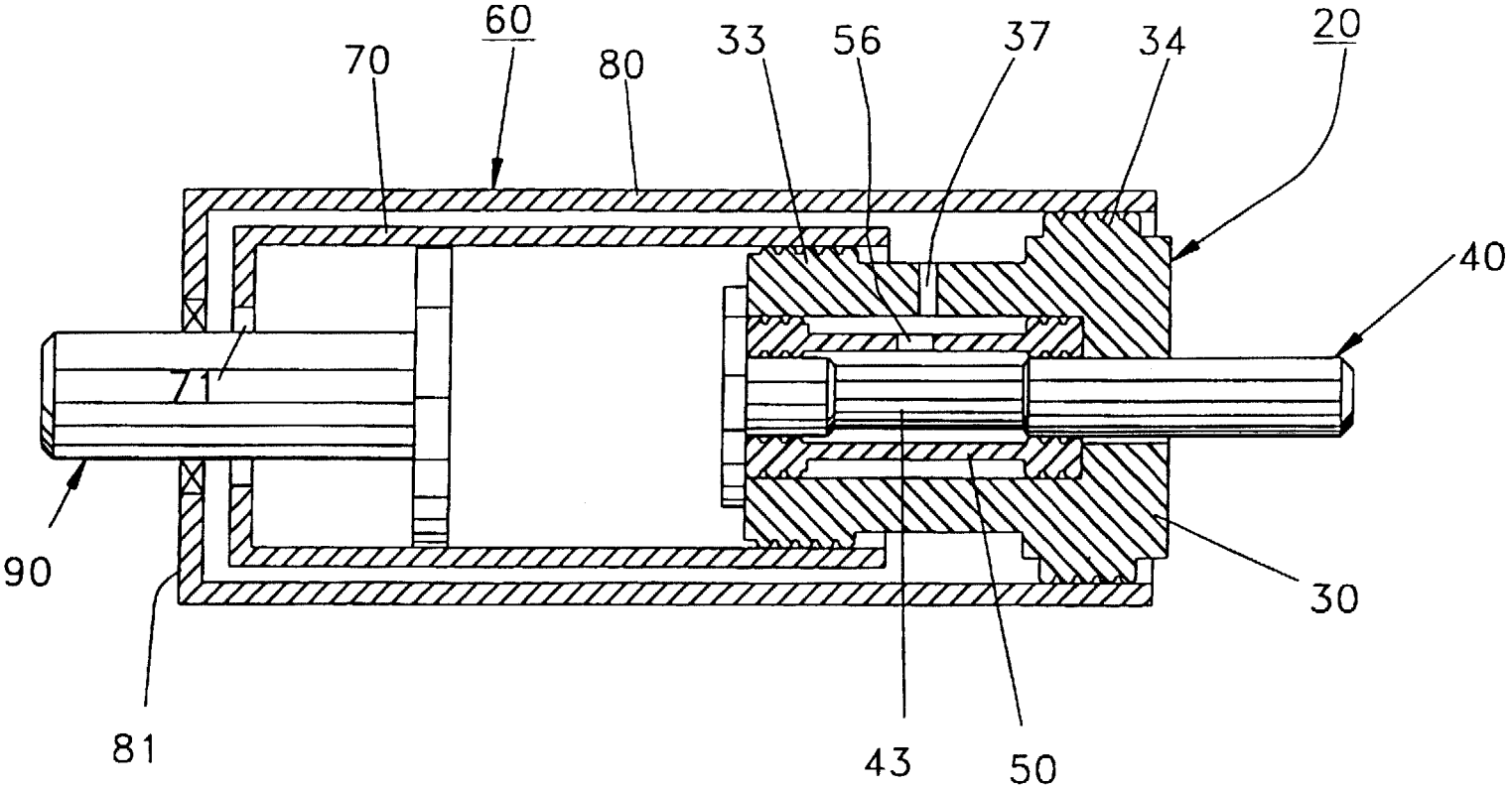
FIGS. 8–11 are similar to FIG. 5, but showing different preferred embodiments of the pressure controlled valve of the present invention.

FIGS. 5–7 illustrate a preferred embodiment of the pressure controlled valve of the present invention. Like the other preferred embodiments respectively shown in FIGS. 8–11, a pressure control valve 20 of the present invention has been mounted inside a cylinder body 60.

Figure 9:
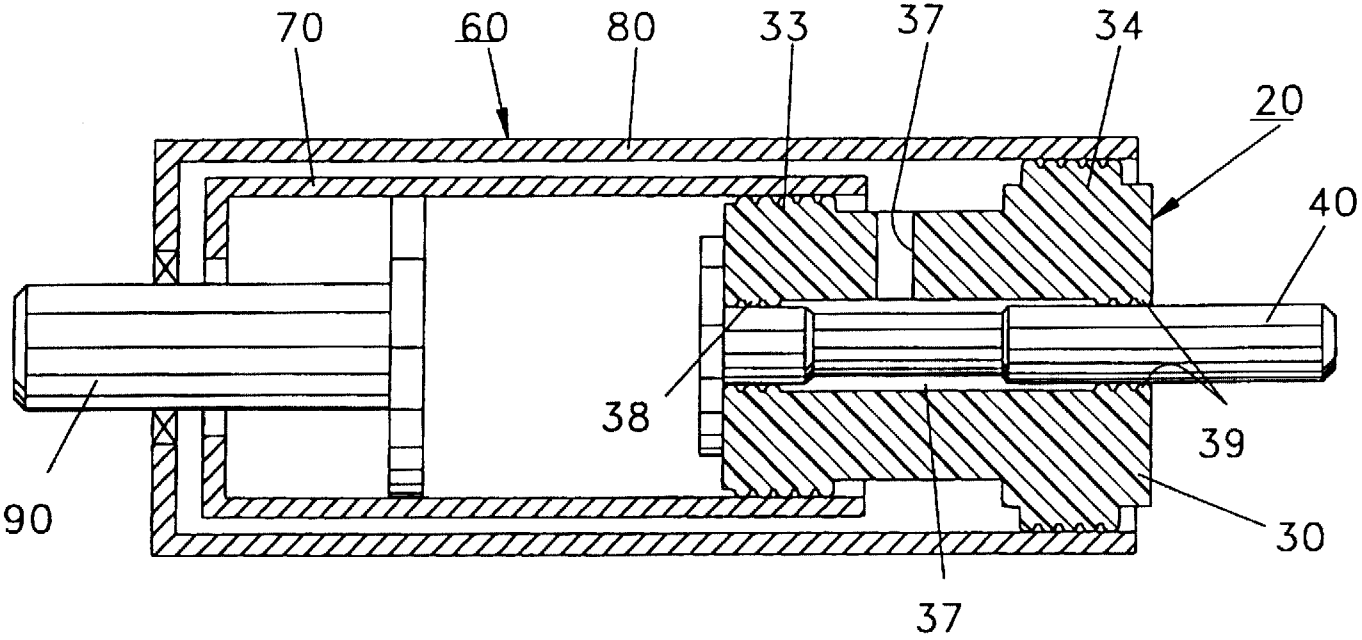
Figure 10:
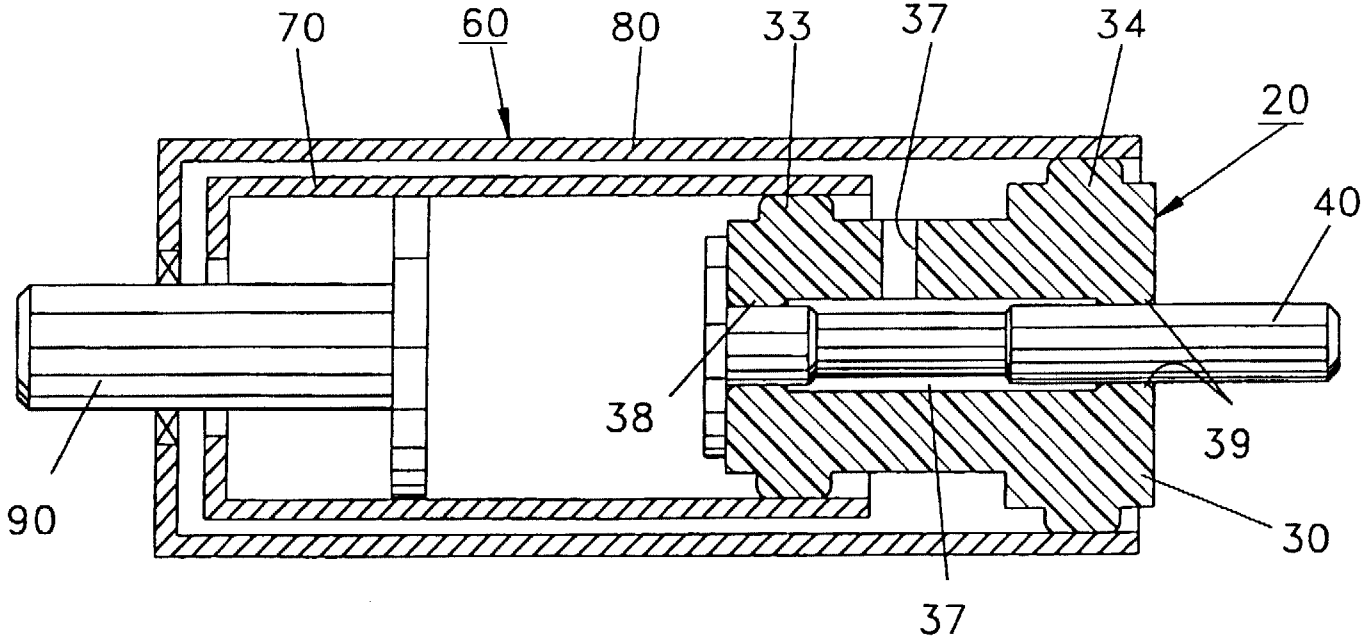

The pressure controlled valve 20 shown in FIGS. 5–8 and FIG. 11 essentially comprises a cylindrical base 30, a hollow sleeve 50 and a T-shaped shaft 40. In the preferred embodiment of the invention shown in FIGS. 9 and 10, the pressure controlled valve 20 consists of a cylindrical base 30 and a T-shaped shaft 40. If the base 30 of the preferred embodiment shown in FIGS. 9 and 10 is separated into a base body and a sleeve accommodated within the base body, then the respective preferred embodiments shown in FIGS. 5–8 and FIG. 11 may be obtained.

In the preferred embodiment shown in FIGS. 5–7, the base 30 has a first end 31 and a second end 32. The first end 31 extends radially and outwardly to a first annular seal portion 33, and the second end 32 also extends radially and outwardly to a second annular seal portion 34 which is concentric with but has a larger diameter than the first annular seal portion In a center of the base is provided a sleeve hole 35 which is adjacent to a shaft hole 36 of a smaller diameter. The sleeve hole 35 and the shaft hole 36 together penetrate an interior of the base 30. There is provided an axial through hole 37 intermediate the first annular seal portion 33 and the second annular seal portion 34. The through hole 37 extends from the sleeve hole 35 through an outer wall of the base 30. There is further provided a hollow sleeve 50 which has a first end 51 and a second end 52. The first end 51 of the sleeve 50 extends radially and outwardly to a first annular portion 53 and fits tightly onto a first inner rim of the base 30. The second end 52 of the sleeve 50 likewise extends radially and outwardly to a second annular portion 54 and fits tightly with a second inner rim of the base 30. A neck-shaped groove 55 is disposed intermediate the first annular portion 53 and the second annular portion 54 of the sleeve 50. There is also provided a radial hole 56 extending from an interior of the sleeve 50 to the groove 55. The shaft 40 has a head portion 41 and a shaft portion the latter fitting tightly with the inner rims of the first end 51 and the second end 52 of the sleeve 50 and passing through the shaft hole 36 of the base 30 via the sleeve 50 to project from the second end 32 of the base 30. The shaft portion 42 of the shaft 40 has a waist portion 43 of a smaller diameter which always aligns with the radial hole 56 of the sleeve 50, and the waist portion 43 has an axial distance D greater than a distance d from the radial hole 56 of the sleeve to the first end 51 of the sleeve 50.

The above-mentioned structure mounted in the cylinder body 60 (such as a pneumatic cylinder) may sufficiently isolates two separate air chambers, a first air chamber S3 and a second air chamber S4 shown by dotted lines in FIG. 5. The cylinder body 60 chiefly consists of a cylindrical cylinder 70, a cylindrical housing 80 and a piston 90. The cylinder 70 has a semi-closed end 72 with a guide hole 71 and an open end 73. The open end 73 has its inner rim tightly contacts the first annular seal portion 33 of the base 30. The housing 80 is disposed on a same axis with the cylinder 70 and has a bearing end 81 and an open end 82. The open end 82 of the housing 80 has its inner rim tightly contacts the second annular seal portion 34 of the base 30. A chamber is provided between the inner rim of the housing 80 and an outer rim of the cylinder 70 for connecting the guide hole 71 of the semi-closed end 72 of the cylinder 70 and the through hole 37 of the base 30 respectively, forming a part of the air chamber S3. The piston 90 has a piston head 91 and a piston rod 92. The piston head 91 contacts tightly with the inner wall of the cylinder 70 and is capable of reciprocating freely along the cylinder 70 in an axial direction, dividing the cylinder 70 into the first and second chambers S3 and S4, the first air chamber S3 communicating with the guide hole 71 of the cylinder 70. The piston rod 92 passes via the semi-closed end 72 of the cylinder 70 out through the bearing end 81 of the housing 80. There is provided an oil seal 83 to seal the joint between the piston rod 92 and the housing 80.

If an external force F is exerted on the shaft 40 (as shown in FIG. 6), the shaft 40 displaces left to its waist portion 43 distal to the first end 51 of the sleeve 50. At this point, gas inside the first air chamber S3 flows from the through hole 37 of the base 30 and the radial hole 56 of the sleeve 50 via the waist portion 43 into the second air chamber S4. Due to change in pressure difference, the piston 90 may then be easily pushed to displace to the left. As long as the shaft 40 is not subjected to any force during displacement of the piston 90, the pressure inside the second air chamber S4 is adequate to force the shaft 40 to displace right to return to its original position, as shown in FIG. 7. At this time, the piston 90 has displaced to the left of the cylinder body 60.

The preferred embodiment of the cylinder employing the pressure controlled valve according to the present invention is substantially similar to that illustrated in FIGS. 5–7, the only difference is that the parts of the base and the annular seal portions of the sleeve are constituted by a plurality of continuous, contiguous, concentric, raised rings.

In FIGS. 9 and 10, the embodiment of the base 30 as shown is a single unit. The cylindrical base 30 has therein a shaft hole 37 and the outer edges of its ends respectively extend outwardly to form two outer annular seal portions 33 and 34 of different diameters. The inner edges of the ends of the base 30 also respectively extend inwardly to form two inner annular seal portions 38 and 39 of the same diameter respectively. Between the two inner annular seal portions 38 and 39, there is provided a radial through hole 37, penetrating between the two outer annular seal portions 33 and 34. The difference between the embodiments respectively shown in FIGS. 9 and 10 lies in the structure of the annular seal portions. In FIG. 9, the structure of the annular seal portions is substantially similar to that of the embodiment shown in FIG. 8 and described above, that is, they are multiple contiguous concentric raised rings in a continuous arrangement.

Figure 11:
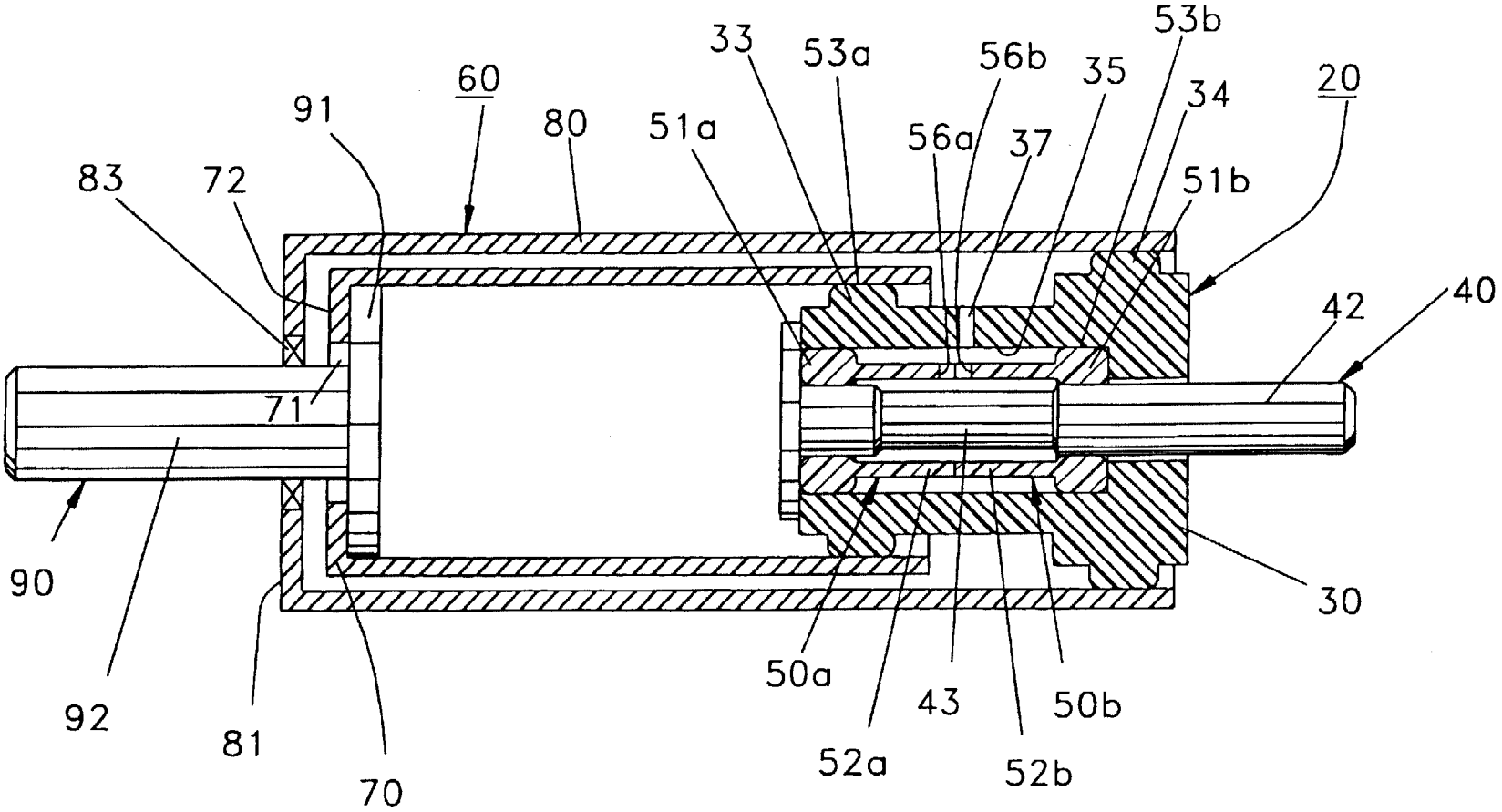

The preferred embodiment shown in FIG. 11 is particularly adapted to be injection molded. The difference between this preferred embodiment and that illustrated in FIGS. 5–7 is that the sleeve element consists of a pair of sleeve units. In this preferred embodiment, a first sleeve unit **50*a* and a second sleeve unit 50*b* which are symmetrical in structure are arranged face-to-face in the sleeve hole 35 of the base 30. The first sleeve unit 50*a* has a first end 51*a* and a second end 52*a*. Likewise, the second sleeve unit 50*b* has a first end 51*b* and a second end 52*b*. The first ends 51*a*, 51*b* of the sleeve units extend radially and outwardly to first form annular portions 53*a*, 53*b* respectively which abut tightly against the inner wall of the sleeve hole 35 of the base 30. The second ends 52*a*, 52*b* face each other in a contiguous relationship, with two symmetrical notches 56*a*, 56*b* defined therebetween, the notches 56a and 56b together constituting a radial hole communicating with the through hole 37 of the base 30**.

Any one of the above-mentioned preferred embodiments, as well as any modified embodiments based thereon, may achieve the actions of the pressure controlled valve of the invention illustrated in FIGS. 5–7. The parts of the pressure-controlled valve and cylinder using the same may be mass produced and have better quality stability than the prior art. Any material, such as high polymer synthetic materials and powders composed of high polymer material and metal (aluminum) or non-metal (graphite), which is suitable for injection molding, extrusion or the like methods, may be used for making the pressure controlled valve of the present invention and the cylinder using the same.

Although the present invention has been illustrated and described with reference to the preferred embodiments thereof, it should be understood that it is in no way limited to the details of such embodiments, but is capable of numerous modifications within the scope of the appended claims. For instance, spring means may be provided in the cylinder, as in the prior art, to urge the head portion 41 of the shaft 40.

What is claimed is:

1. A pressure controlled valve for controlling a piston of a cylinder, said pressure controlled valve comprising:

a cylindrical base having a shaft hole in its interior, said base having two ends with their outer edges extending outwardly to form respective bulging annular outer seal portions of different diameters and their inner edges extending inwardly to form respective bulging annular inner seal portions of a same diameter, a radial through hole being disposed between said annular outer seal portions and passing through to between said annular inner seal portions;

said annular inner and outer seal portions being integral with and unitary to the cylindrical base and a T-shaped shaft consisting of a head portion and a shaft portion, said shaft portion being in tight contact with said annular inner seal portions and having a waist portion of a smaller diameter.

2. The controlled valve as claimed in claim 1, wherein the annular or outer seal portions and the annular inner seal portions of said base are formed by contiguous concentric raised rings arranged in a continuous relationship.

* * * * *